US010443919B2

(12) United States Patent
Sillince

(10) Patent No.: US 10,443,919 B2
(45) Date of Patent: Oct. 15, 2019

(54) SELF-COOLING FOOD OR BEVERAGE CONTAINER HAVING A HEAT EXCHANGE UNIT USING LIQUID CARBON DIOXIDE AND HAVING A DUAL FUNCTION VALVE

(71) Applicant: JOSEPH COMPANY INTERNATIONAL, INC., Irvine, CA (US)

(72) Inventor: Mark Sillince, West Sussex (GB)

(73) Assignee: JOSEPH COMPANY INTERNATIONAL, INC., Irvine, CA (US)

( * ) Notice: Subject to any disclaimer, the term of this patent is extended or adjusted under 35 U.S.C. 154(b) by 0 days.

(21) Appl. No.: 15/557,982

(22) PCT Filed: Mar. 18, 2016

(86) PCT No.: PCT/US2016/023194
§ 371 (c)(1),
(2) Date: Sep. 13, 2017

(87) PCT Pub. No.: WO2016/154025
PCT Pub. Date: Sep. 29, 2016

(65) Prior Publication Data

US 2018/0045450 A1 Feb. 15, 2018

Related U.S. Application Data

(60) Provisional application No. 62/136,176, filed on Mar. 20, 2015.

(51) Int. Cl.

| | |
|---|---|
| ***F25D 3/10*** | (2006.01) |
| ***F25D 29/00*** | (2006.01) |
| ***F25D 31/00*** | (2006.01) |

(52) U.S. Cl.
CPC ..... *F25D 3/107* (2013.01); *F25D 29/006* (2013.01); *F25D 31/003* (2013.01); *F25D 2331/805* (2013.01); *F25D 2700/10* (2013.01)

(58) Field of Classification Search
CPC ..... F25D 3/107; F25D 29/006; F25D 31/003; F25D 2331/805
(Continued)

(56) References Cited

U.S. PATENT DOCUMENTS 3,373,581 A 3/1968 Strader
3,597,937 A * 8/1971 Parks ..... F25D 3/107 62/294
(Continued)

FOREIGN PATENT DOCUMENTS

WO WO 2015/168304 A1 11/2015

OTHER PUBLICATIONS

PCT/US2016/023194—Mar. 18, 2016—International Search Report dated Jun. 3, 2016.

*Primary Examiner* — Elizabeth J Martin
(74) *Attorney, Agent, or Firm* — Karish & Bjorgum, PC

(57) ABSTRACT

A self-chilling food or beverage container including an outer container and a heat exchange unit (HEU) secured internally of said outer container and having liquid carbon dioxide (CO2) therein, the HEU including a valve member which provides a restricted orifice in one position to allow the liquid CO2 to pass from the liquid state directly to the gaseous state while maintaining pressure in the HEU to keep the residual CO2 in the liquid state and in a second position to provide a substantially unrestricted flow path to permit liquid CO2 to be inserted into the HEU.

10 Claims, 10 Drawing Sheets

(58) Field of Classification Search
USPC ..... 62/604
See application file for complete search history.

(56) References Cited

U.S. PATENT DOCUMENTS 4,669,273 A 6/1987 Fischer et al.
4,688,395 A 8/1987 Holcomb
4,888,955 A * 12/1989 Tyree, Jr. ..... F17C 7/02 62/384
5,148,679 A * 9/1992 Eve ..... C01B 32/55 62/602
5,214,925 A * 6/1993 Hoy ..... F04B 15/06 417/901
5,331,817 A 7/1994 Anthony
5,655,384 A * 8/1997 Joslin, Jr. ..... F25D 3/107 126/263.09
5,692,381 A 12/1997 Garrett
6,125,649 A 10/2000 Sillince
6,128,906 A * 10/2000 Sillince ..... A47G 19/2288 62/371
7,185,511 B2 3/2007 Ryan et al.
7,275,395 B1 * 10/2007 Ventura ..... C01B 32/55 62/602
8,128,906 B2 3/2012 Anderson
2002/0116942 A1 8/2002 Suh
2008/0230098 A1 * 9/2008 Lindqvist ..... B08B 7/0021 134/107
2010/0326134 A1 * 12/2010 Johnke ..... F25J 3/0209 62/620
2011/0272166 A1 * 11/2011 Hunt ..... B01D 53/002 166/402
2012/0186296 A1 * 7/2012 Gnanendran ..... B01D 53/1456 62/637
2013/0174581 A1 * 7/2013 Rasmussen ..... F25D 5/02 62/4
2013/0213080 A1 8/2013 Cull et al.
2013/0305757 A1 * 11/2013 Conjeevaram ..... F25B 7/00 62/129

* cited by examiner

SELF-COOLING FOOD OR BEVERAGE CONTAINER HAVING A HEAT EXCHANGE UNIT USING LIQUID CARBON DIOXIDE AND HAVING A DUAL FUNCTION VALVE

RELATED APPLICATION

This application is a non-provisional application which claims the benefit and filing date of provisional application Ser. No. 62/136,176, filed Mar. 20, 2015 for SELF-COOLING FOOD OR BEVERAGE CONTAINER HAVING A HEAT EXCHANGE UNIT USING LIQUID CARBON DIOXIDE AND HAVING A DUAL FUNCTION VALVE.

BACKGROUND OF THE INVENTION

Field of the Invention

The present invention relates generally to containers for holding food or beverage in which there is also included a heat exchange unit using liquid carbon dioxide and having an outer surface which contacts the food or beverage and which when activated alters the temperature of the food or beverage.

It has long been desirable to provide a simple, effective and safe device which may be housed within a container such as a food or beverage container for the purpose of altering the temperature of the food or beverage on demand.

In many instances, such as where one is in locations where ice or refrigeration are not readily available such as camping, at the beach, boating, fishing or the like it is desirable to have beverages which can be cooled before consumption. In the past it has been necessary that the individual take an ice chest or the like which contains ice and the containers for the beverages so that they can be cooled and then consumed in the manner desired. The utilization of such ice chests is cumbersome, takes up a substantial amount of space and lasts for only a very limited time after which the ice must be replaced. While in use it is also necessary that the water resulting from the melted ice be drained from the ice chest from time to time.

As a result of the foregoing, there have been numerous instances of attempts to provide a container housing a food or beverage and also housing therein a heat exchange unit which when activated would cool the food or beverage contained therein. The heat exchange units in such prior art devices housed a refrigerant material usually under pressure which when released would absorb the heat in the surrounding food or beverage thereby cooling the same prior to consumption. The refrigerants utilized in the heat exchange units of the prior art included gases under pressure such as hydroflourocarbons, ammonia, liquid nitrogen, carbon dioxide, and liquid carbon dioxide. There has also been developed a system using compacted carbon particles which adsorb carbon dioxide gas under pressure. When the HEU is exposed to the atmosphere by opening a valve, the carbon dioxide gas desorbs and cools the food or beverage in the container. Examples of such systems are shown in U.S. Pat. Nos. 7,185,511, 6,125,649 and 5,692,381. Examples of such prior art patents including carbon dioxide in its gas or liquid form is shown by U.S. Pat. Nos. 3,373,581; 4,688,395; and 4,669,273. The containers utilizing such heat exchange units as illustrated in the prior art are complex and difficult to manufacturer, thus causing great expense, rendering such prior art self-chilling beverage containers commercially unattractive. In addition, where liquid carbon dioxide was utilized, the release of the liquid carbon dioxide resulted in the liquid carbon dioxide transitioning into the solid state (dry ice) which provided only limited reduction in temperature of the food or beverage. As a result of the foregoing there exists a need for a simple, easy to assemble and efficient self cooling system for a food or beverage.

SUMMARY OF THE INVENTION

A food or beverage containing assembly comprising an outer container for receiving a food or beverage and having a top and a bottom, the bottom defining an opening therethrough, a heat exchange unit (HEU) including a metallic inner container filled with liquid carbon dioxide (CO2) and adapted to be secured to the outer container in the opening. A valve member secured to said HEU for providing a restricted orifice, when activated, to create a dis-equilibrium to permit the liquid CO2 to pass directly from the liquid state to the gaseous state but at the same time to maintain the remaining CO2 in the HEU in its liquid state. The valve member includes a valve stem that provides the dual function of charging the HEU with liquid CO2 and providing the restricted orifice.

DETAILED DESCRIPTION OF THE DRAWINGS

Figure 1:
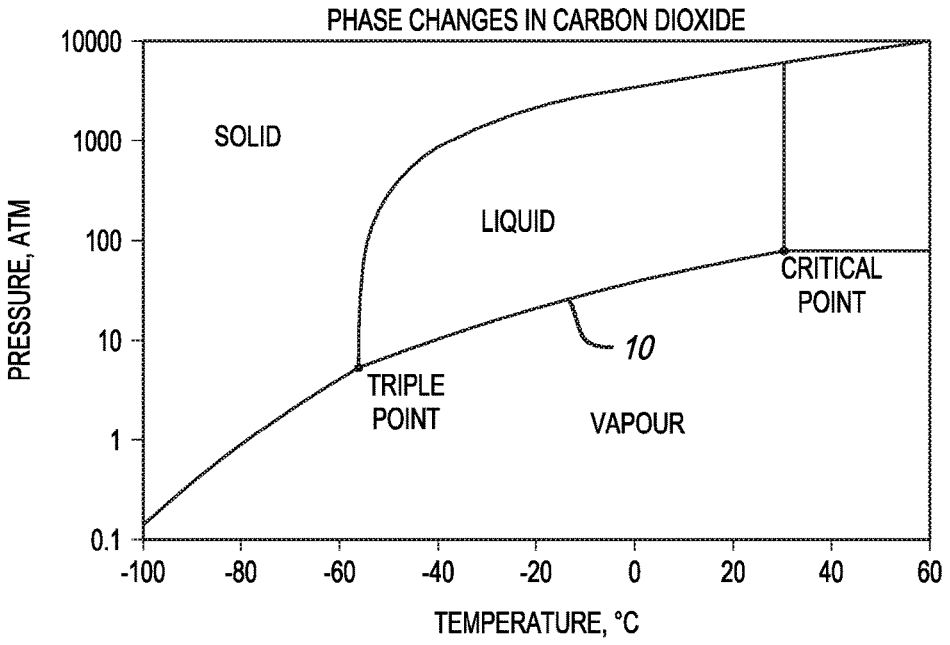
FIG. 1 is a phase diagram of carbon dioxide illustrating the pressure and temperature at which the CO2 is solid, liquid, gas and supercritical fluid.

Referring now more particularly to FIG. 1, there is illustrated a phase diagram for carbon dioxide. As is therein illustrated, the carbon dioxide may have a solid phase, a liquid phase or a vapor or gas phase. In accordance with the principles of the present invention it is critical that the carbon dioxide be maintained in its liquid phase and prevented from passing into a solid phase where dry ice is formed during the time that the heat exchange unit is being utilized to lower the temperature of the food or beverage within the container. As is shown, the triple point on the phase diagram is the point at which the three states of matter (gas, liquid and solid) coexist. The critical point is the point on the phase diagram at which the substance, in this instance the carbon dioxide, is indistinguishable between liquid and gaseous states. The vaporization (or condensation) curve is the curve 10 on the phase diagram which represents the transition between the liquid and vapor or gaseous states. As is shown, the phase diagram plots pressure typically in atmospheres on the ordinate versus temperature on the abscissa, in this case, in degrees Celsius. The lines represent the combinations of pressures and temperatures at which two phases, liquid and vapor, can exist in equilibrium. In other words, these lines define phase change points. In accordance with the principles of the present invention, the heat exchange unit is charged with carbon dioxide at a temperature and pressure such that the carbon dioxide is in its liquid state. The heat exchange unit is then sealed so that the liquid state is retained in equilibrium within the heat exchange unit until such a time as it is desired to cool the food or beverage within the container which surrounds the heat exchange unit. At that point, dis-equilibrium is created so that the liquid carbon dioxide is allowed to pass into the vapor or gaseous state but at the same time it is critical that the pressure within the heat exchange unit is maintained such that any carbon dioxide which still exists within the heat exchange unit is maintained in its liquid state. This is accomplished, as will be described in greater detail hereinbelow, by providing a path for the liquid carbon dioxide to pass from its liquid to its gaseous state and exhaust to the atmosphere by passing through a restricted orifice which has a pressure drop such that the pressure within the heat exchange unit is maintained so that the residual carbon dioxide which is contained within the heat exchange unit remains in its liquid state until such a time as all of the liquid carbon dioxide passes from its liquid state to its gaseous state and passes through the restricted orifice to the atmosphere, thereby completely exhausting the liquid carbon dioxide in the heat exchange unit.

Figure 2:
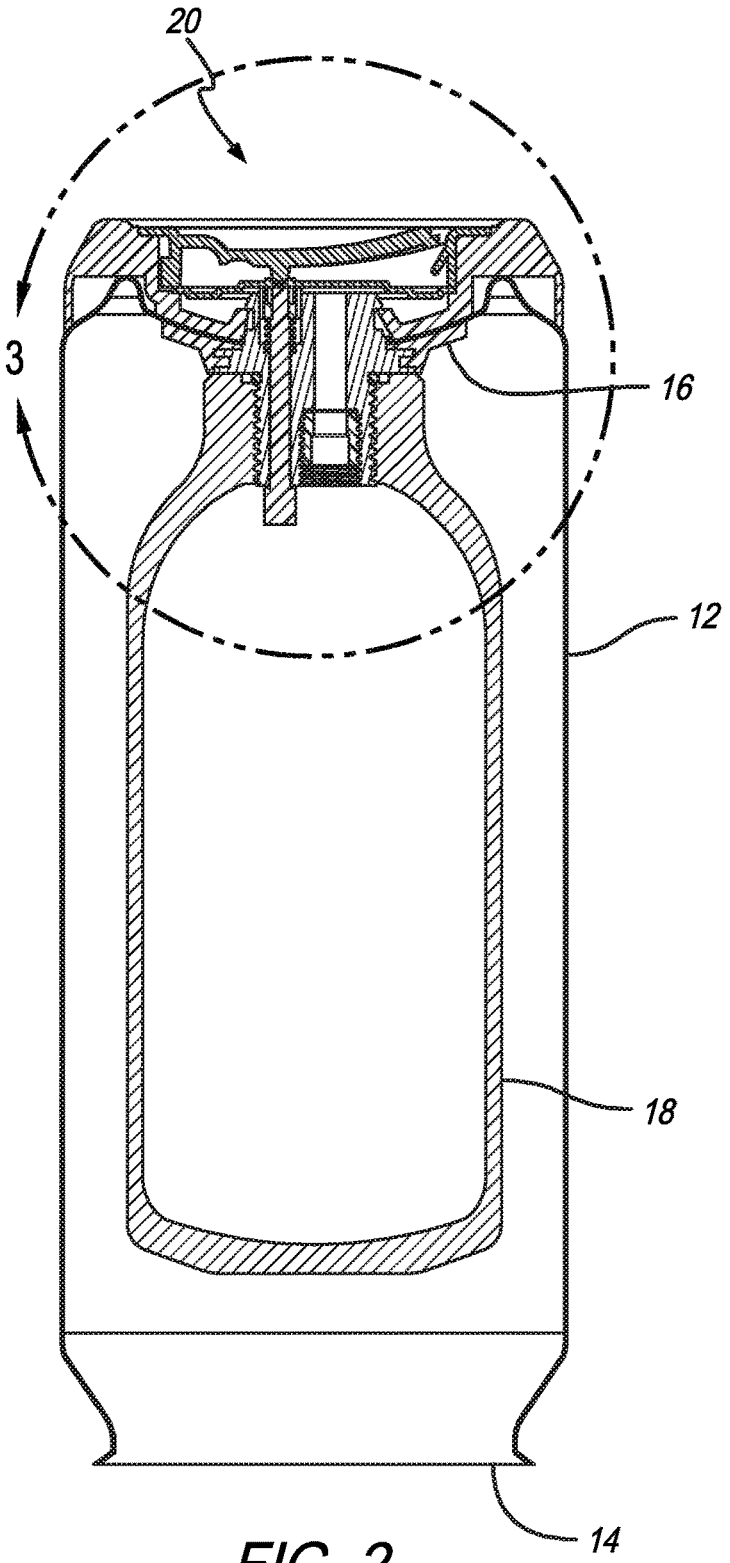
FIG. 2 is a partial cross-sectional view showing the combination of the HEU and the container in which it is housed.

Referring now more particularly to FIG. 2, there is illustrated partially in cross section a beverage container 12 having a top 14 and a bottom 16. The bottom 16 has an opening therein to which is attached a heat exchange unit 18. Food or beverage contained within the container 12 surrounds the exterior of the heat exchange unit (HEU) which is charged with liquid carbon dioxide which when released by way of a valve mechanism shown generally at 20 and which will be more fully described hereinafter will lower the temperature of the food or beverage to a desired level for consumption. The top 14 is open during the manufacturing process to permit the insertion of the HEU into the position shown in FIG. 2.

Figure 3:
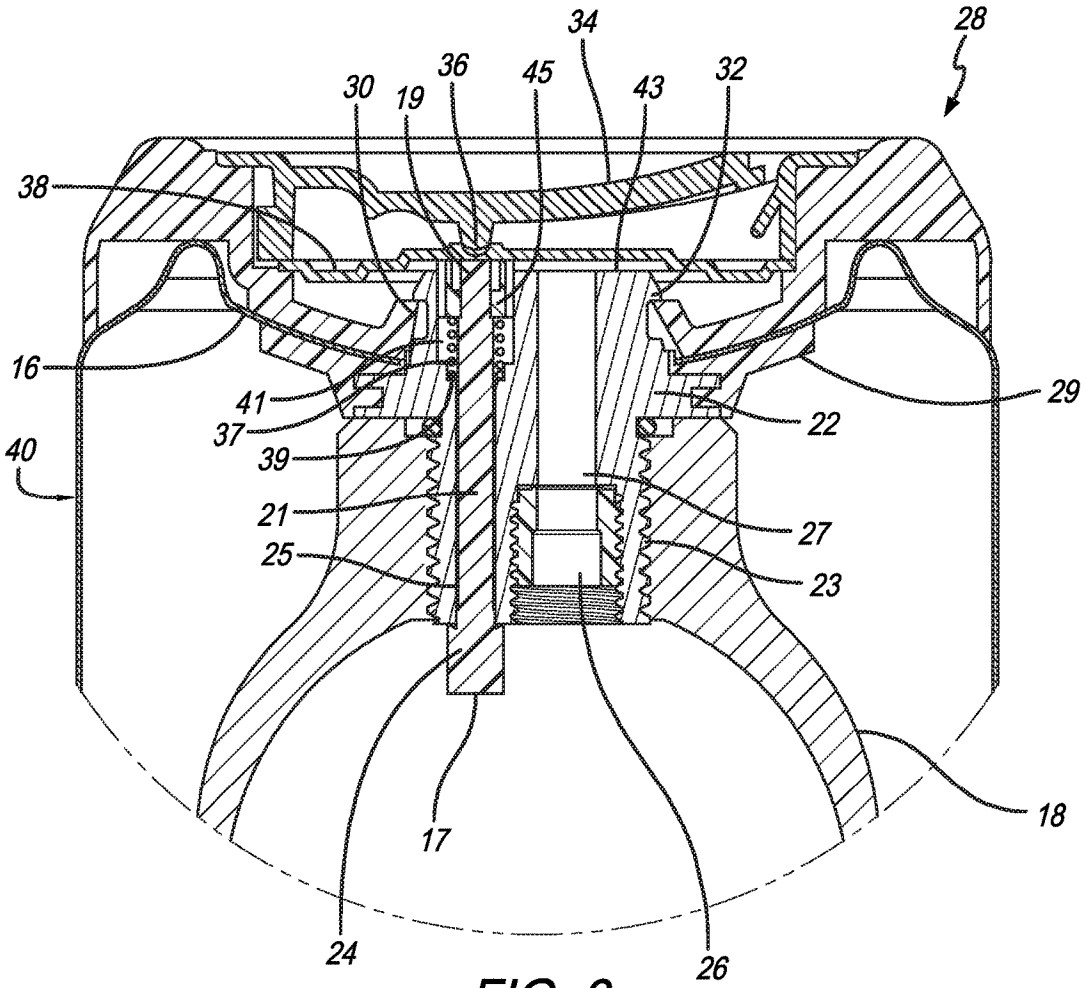
FIG. 3 is a cross-sectional view in more enlarged detail of the portion of FIG. 2 marked 3-3.

Referring now more particularly to FIG. 3, the area shown in FIG. 2 circled in a dashed line and labeled as 3 is shown in greater detail. As is illustrated in FIG. 3, there is provided a fitting or attachment adapter 22 which is metal and preferably aluminum and includes threads 23 formed thereon to be threadably received within the upper open portion of the HEU 18 which has complementary threads thereon. The attachment adaptor 22 receives a plastic valve member 24 having first 17 and second 19 ends in an opening or a first bore 25 provided therethrough and also receives a burst disc assembly 26 which is also threadably received within an opening or second bore 27 provided within the attachment adaptor 22. The attachment adaptor 22 has a plastic overmolded base support ring 29 which is applied thereto in a overmolding process in which the plastic member is formed by injection molding of polypropylene into a mold into which the attachment adaptor 22 has been placed. The support ring 29 includes an outwardly extending flange having a top surface which seats against the bottom portion 16 of the beverage can 12 and the entire assembly of the attachment adaptor 22, valve 24 and burst disk assembly 26 is held in place by a base component 28 which will be described in greater detail below. The base component 28 has a snap ring member 30 formed by a plurality of claws that snaps over a circumferential protrusion 32 on the upper portion of the attachment adaptor 22 and thereby secures the HEU with the valve assembly 20 and the burst disk assembly 26 onto the bottom of the beverage can 12. A plastic washer (not shown) may also be seated between the bottom of the can and the upper surface of the base support ring. A button component 34 is held in place in the base component 28 and, when moved downwardly, a protrusion 36 will engage the upper or second end 19 of the plastic valve member 24 and push it downwardly against the force of the valve spring 37 to provide a restricted orifice through which the liquid carbon dioxide contained within the HEU may enter the gaseous state and escape the HEU. The valve spring 37 is seated against a shoulder 39 formed by a reentrant bore 41 of the first bore 25 in the top or upper surface 43 of the attachment adaptor 22 and the lower surface of the plastic valve retainer 45 which is snap fitted to the top of the valve stem 21. The gaseous state CO2 will pass along a restricted flow path between the exterior of the plastic valve and the opening provided in the attachment adaptor 22 so that the liquid CO2 which now is passing from the liquid state to the gaseous state may flow upwardly around the outer surface of the plastic valve stem 21 to exit the attachment adaptor 22. There is, however, a gas deflector 38 which is positioned across the upper portion of the attachment adaptor 22 and operates such that when the carbon dioxide in the gaseous state flows upwardly through the opening around the valve stem 21 of the plastic valve 24, it will be deflected radially outwardly and it will then be caused to be deflected downwardly by the base component along the outer surface 40 of the beverage can 12 as will be described more fully below.

Figure 4:
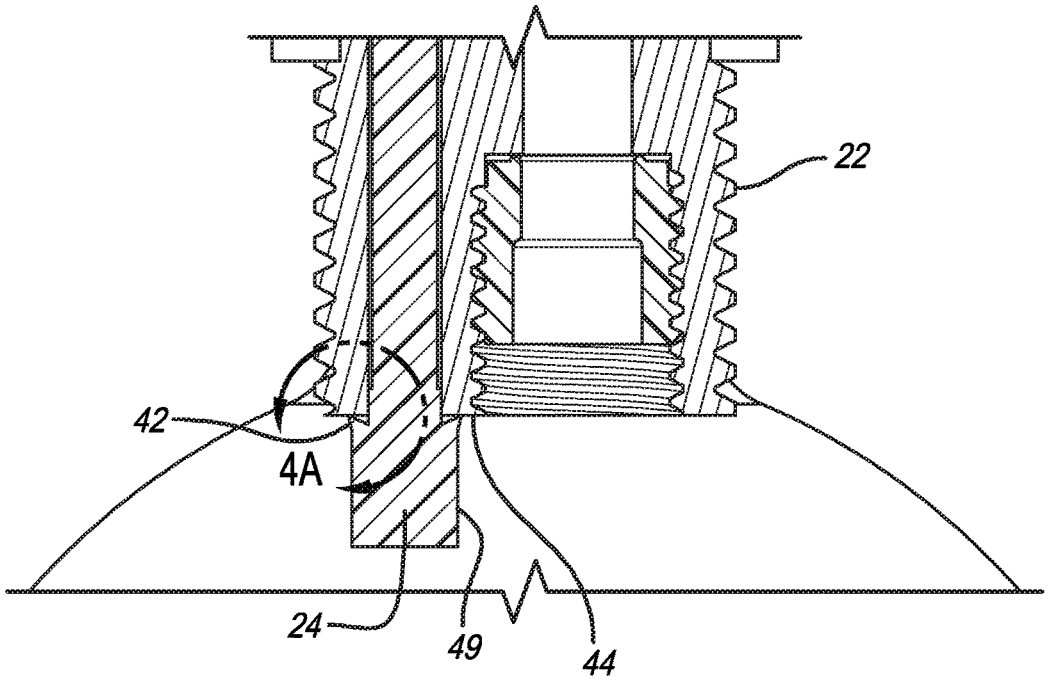
FIG. 4 is a schematic illustration showing the valve of the present HEU.
Figure 4A:
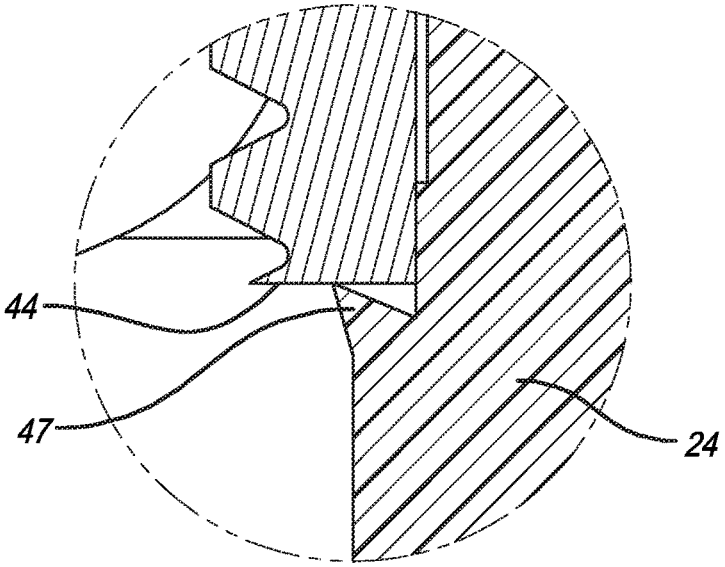
FIG. 4A is a partial view showing the sealing function of the valve.
Figure 5:
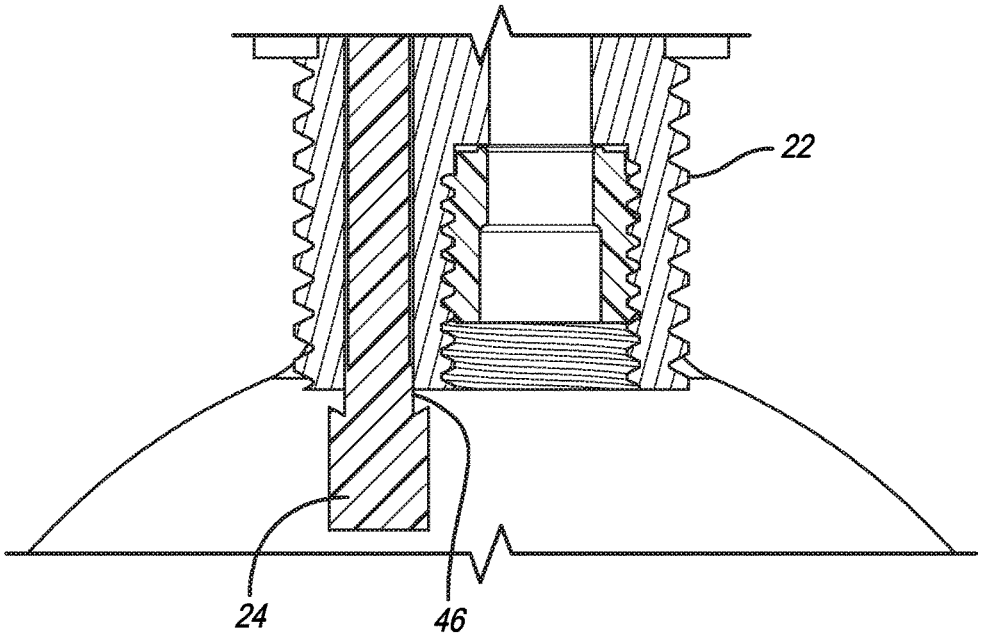
FIG. 5 is an enlarged view showing the valve of FIG. 4 in its venting position.

Referring now more particularly to FIG. 4, the plastic valve 24 is illustrated in greater detail. As is therein shown, the plastic valve 24 is molded with an outwardly extending lower portion 49 which has a continuous sharp edge 42 which engages the lower surface 44 of the attachment adaptor 22 to provide a very effective seal. The valve 24 is molded of a polymer material which has some flexibility. As is shown in FIG. 4A the sharp edge 42 of the valve 24 bends slightly outwardly against the surface 44 as shown at 47 to more effectively create the seal. The forces exerted on the valve 24 by the valve spring 37 and the pressure of the liquid CO2 in the HEU cause this bending. As is shown in FIG. 5 to which reference is hereby made when the valve 24 is depressed downwardly as illustrated in FIG. 5, the section 46 has a first surface which is still within the bore 25 provided in the attachment adaptor 22 and functions to provide the pressure drop and the desired throttle to maintain the liquid carbon dioxide within the HEU in the boiling state so that it passes directly from the liquid to the gaseous state. This prevents the formation of dry ice and thus allows maximum cooling according to the enthalpy of vaporization. The section 46 of the valve 24 and the diameter of the bore 25 in the region where the section 46 resides are dimensioned to provide a gap between two and fourteen microns when the section 46 is perfectly concentric in the bore 25. If the section 46 is not perfectly concentric then the dimensions are such that a maximum gap of between four and 28 microns is provided. The gap extends for the entire length of the section 46 which in accordance with the presently preferred embodiment is 0.5 mm. This gap provides the critical restricted orifice which when activated allows the liquid carbon dioxide to pass directly from the liquid state to the gaseous state but at the same time maintains the pressure in the HEU such that all of the residual carbon dioxide remains in the liquid state.

Figure 6:
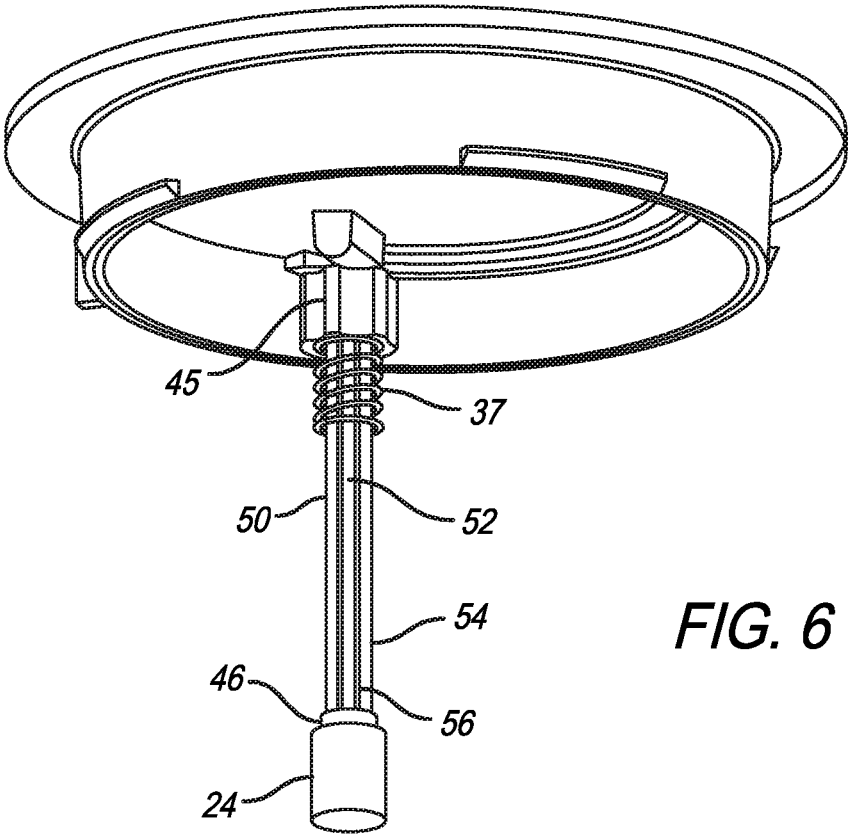
FIG. 6 is a perspective view showing the construction of the valve stem.

As shown in FIG. 6 to which reference is hereby made, the valve 24 has the section 46 that cooperates with the bore 25 in the attachment adaptor 22 as above described. In addition thereto, the stem 21 of the valve 24 is formed with a second surface 56 having a smaller diameter than the first surface and is formed with a plurality of slots or flutes, some of which are shown at 50, 52 and 54. These slots operate to provide a greater flow area than is provided by the restricted orifice between the section 46 and the bore 25 in the attachment adaptor 22 and are used to charge the HEU with the liquid carbon dioxide. The charging is accomplished by pressing the valve 24 downwardly so that the section 46 extends below the bore 25 and only the second surface 56 is now within the bore 25 and at that time the carbon dioxide in liquid form under pressure from a source (not shown) is allowed to pass through the valve 24 through the slotted area 56 into the interior of the HEU in a substantially unrestricted flow path. This is maintained for a period of time, seconds, sufficient to permit the desired amount of liquid carbon dioxide to enter the HEU. At the present time, it is determined that between 85 and 95 grams of carbon dioxide in liquid form passes into the HEU. It also should be understood that the source of the carbon dioxide in liquid form is approximately 150 pounds per square inch (psi) (10.34 bar) and that the application of this pressurized source to the upper portion of the valve 24 will also cause it to move downwardly to allow the slotted area 56 to come into operation to allow the carbon dioxide to flow into the HEU.

Figure 6A:
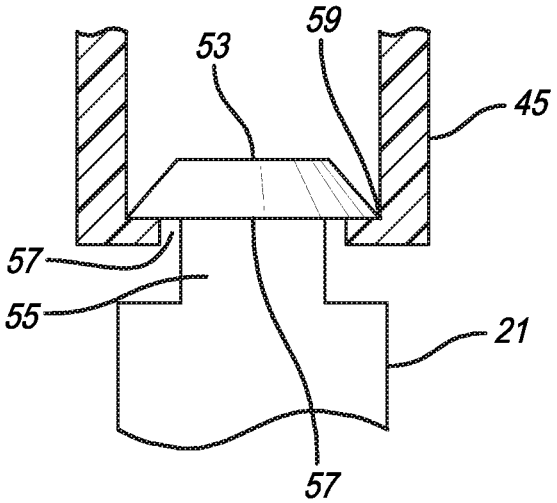
FIG. 6A is a detail showing how a retainer is secured to the valve stem.

It is better shown in FIG. 6 that the valve spring 37 is seated within the opening 41 of the attachment adaptor 22 and also operates against the retainer 45 which is snap fitted onto the upper portion of the valve 24 and functions to retain the seal between the sharp portion 42 of the valve 24 and the lower surface 44 of the attachment adaptor 22 when the unit is in its sealed condition. The plastic valve retainer 45 is a molded member of polypropylene and that piece is press fitted over the end of the valve stem and it holds the spring 37 in place internally and is put in place once the valve is put through the bore 25 in the attachment adapter 22. The spring 37 is dropped in and then the retainer 45 is snapped onto the top of the stem 21. Referring now to FIG. 6A, the end of the valve stem 21 is shown at 53 and there is a groove 55 that is formed that provides a shoulder 57 that runs all the way around. The retainer 45 also has a shoulder 59 and when it is pressed down, it will actually expand going over the end 53 and then snap back into place and it then holds the retainer 45 on the end of the valve stem 21. FIG. 6A illustrates the manner in which the retainer is held in place on the valve stem 21.

Figure 7:
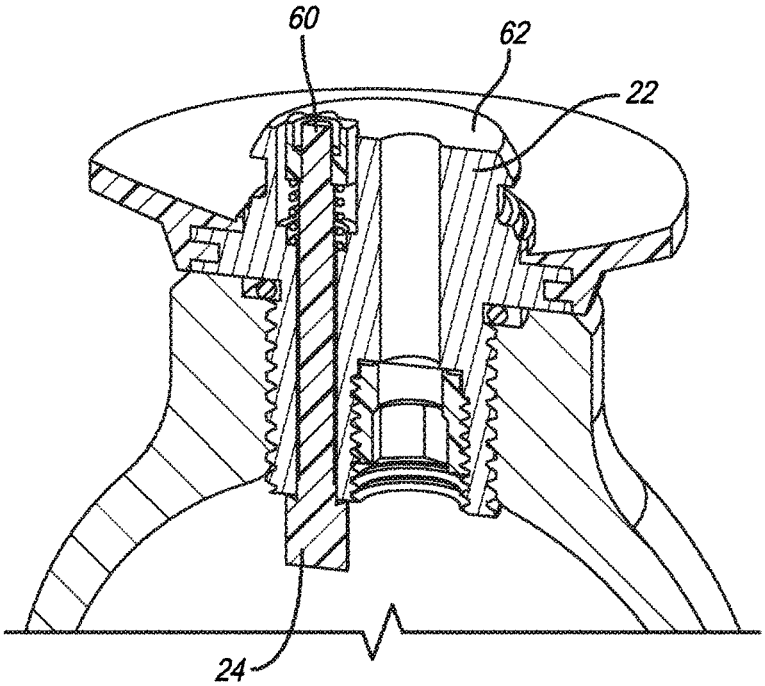
FIG. 7 is a cross-sectional view showing the valve in its closed position.

FIG. 7 to which reference is hereby made shows the valve 24 in its closed position and is sealed. A valve top 60 protrudes slightly above the top 62 of the attachment adaptor 22 so that it is accessible to the button protrusion for operation as above discussed in conjunction with FIG. 3.

Figure 8:
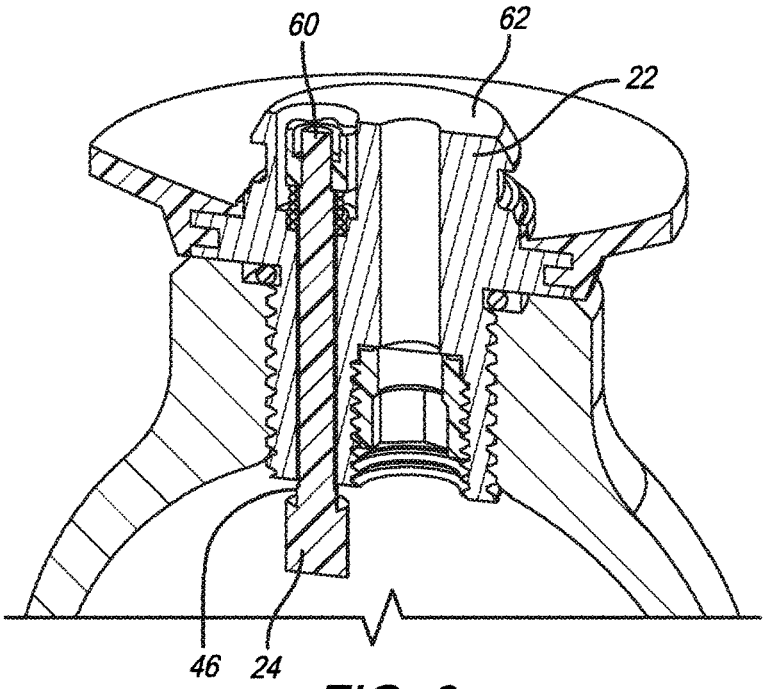
FIG. 8 is a cross-sectional view showing the valve in its position to permit liquid CO2 to be inserted into the HEU.

Referring now to FIG. 8, the valve 24 is shown in its gassing or charging position. As is herein shown, the filling head on the source of liquid CO2 (not shown) depresses the valve downwardly so that it is well below the upper surface 62 of the attachment adaptor 22 and in the preferred embodiment, it should be one millimeter below the top 62. This then causes the section 46 of the valve 24 to be out of the bore 25 in the attachment adaptor 22 to thereby cause the slotted area 56 to come into operation as above discussed in conjunction with FIG. 6. This then creates the substantially unrestricted gas flow path for charging the HEU with the liquid CO2 very quickly and without generating heat.

Figure 9:
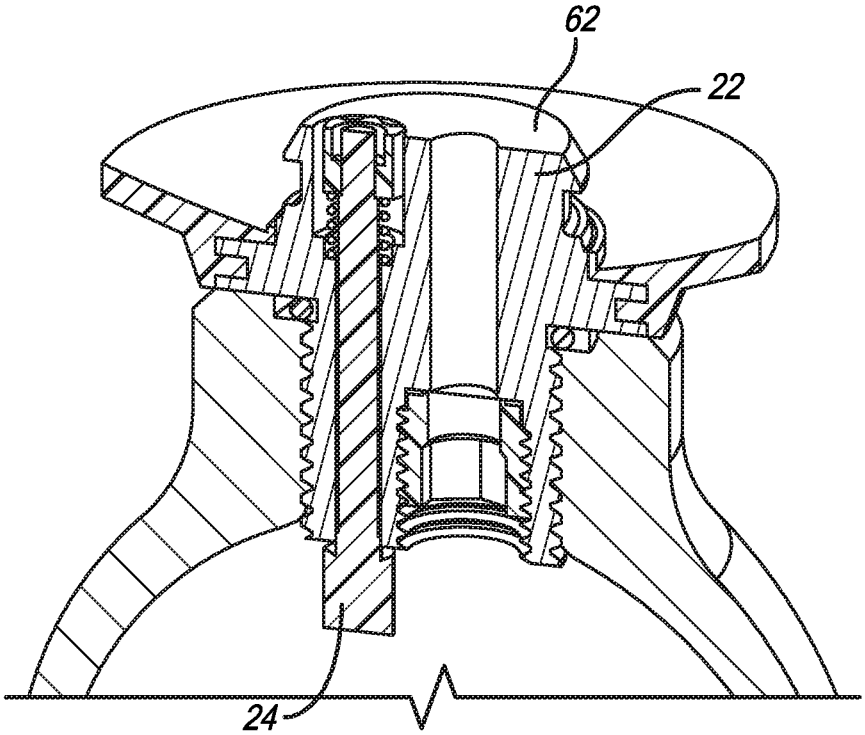
FIG. 9 is a cross-sectional view showing the valve in its venting position.

Referring now to FIG. 9, the valve 24 is shown in the venting position which is accomplished by pressing the button downwardly so that the protrusion engages the top of the valve. This position opens the valve but keeps the section 46 inside the bore 25 thereby creating the restricted orifice or the throttle needed to maintain the carbon dioxide in the liquid state boiling so that it passes from the liquid to the gaseous state without the formation of solid CO2.

Figure 10:
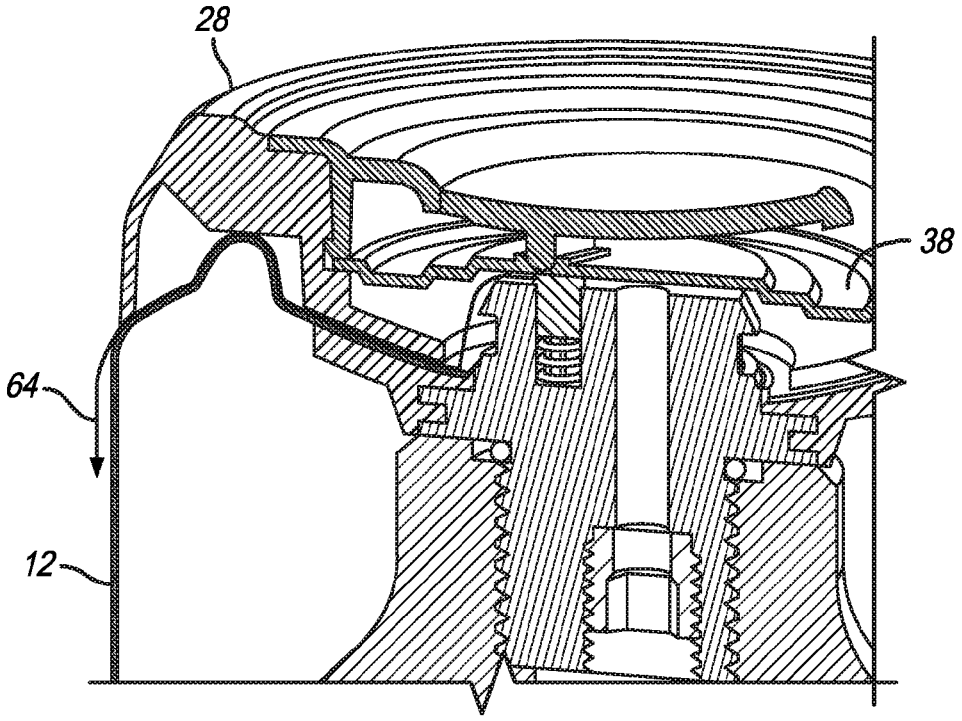
FIG. 10 is a cross-sectional view illustrating the function of the valve in deflecting the gaseous CO2 as it is exhausted from the HEU.

Referring now more particularly to FIG. 10, the function of the gas deflector is shown in greater detail. As is therein illustrated, when the liquid carbon dioxide passes into the gaseous state and flows upwardly through the space between the valve stem 21 and the bore 25 in which it is seated as above described, it will be deflected by the gas deflector 38 and then pass outwardly between the lower surface of the base component 28 and the outer surface of the center container 12 and is then deflected down along the outer surface of the outer container 12 as illustrated by the arrow 64.

Figure 11:
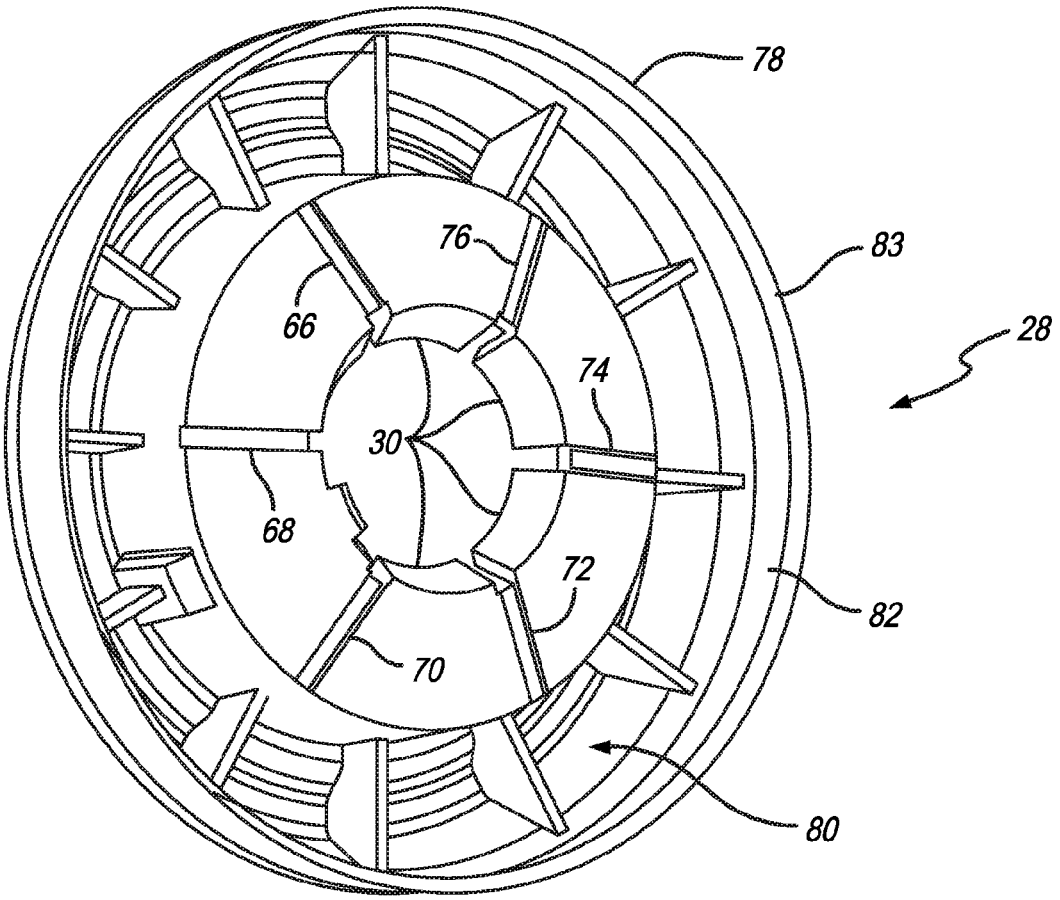
FIG. 11 is a perspective view showing the cap of the base component as shown in FIG. 3.

Referring now more particularly to FIG. 11, the base component 28 is illustrated in greater detail. The illustration of the base component 28 in FIG. 11 is a perspective view of the interior surface of the base component 28 which creates the flow path for the liquid CO2 in a gaseous state to be deflected and passed so that it moves outwardly and downwardly around the outer surface of the beverage container 12. As is shown, there are a plurality of grooves 66 through 76 extending radially outwardly through which the CO2 in the gaseous form may flow toward the outer periphery 78 of the base component 28. The gas under this circumstance will then pass into the area shown generally at 80 and then will be deflected downwardly by the inner surface 82 of a downwardly directed outer circumferential flange 83 of the base component 28 causing it to move downwardly along the outer surface of the beverage can 12 as above described to enhance the cooling effect of the escaping gaseous CO2. The plurality of claws 30 which are used to secure the HEU assembly to the beverage can 12 are shown in better detail. As will be understood by those skilled in the art, when the base component 28 is snapped into place the claws will move outwardly over the protrusion 32 and then back into the groove to be secured.

What is claimed is:

1. A self-chilling food or beverage container having a heat exchange unit using liquid carbon dioxide comprising:

an outer container for receiving a food or beverage;

the heat exchange unit including an inner container having an opening therein secured to said outer container and extending into said outer container so that an outer surface thereof is in contact with a food or beverage received within said outer container;

a burst disc;

an attachment adapter having an upper and lower surface and defining a first bore therethrough and a circumferential protrusion adjacent the upper surface thereof secured to said heat exchange unit at said opening therein, a second bore defined therein, said burst disc being received within said second bore, said burst disc being in constant communication with said liquid carbon dioxide and adapted to rupture if the pressure of said liquid carbon dioxide exceeds a predetermined amount;

a valve member having first and second ends seated in said first bore in said attachment adapter, said valve member having a first diameter defining a first continuous surface adjacent the first end thereof spaced from said bore between 2 and 28 microns and a second diameter smaller than said first diameter defining a second surface extending from said first surface spaced from said bore to provide a flow path to permit liquid carbon dioxide under pressure to be unrestrictedly inserted into said inner container;

a seal between said valve member and said attachment adapter so that liquid carbon dioxide in said inner container is retained at a pressure and temperature to remain at equilibrium in said liquid state;

said first continuous surface, when said seal is removed, providing a restricted orifice to generate disequilibrium to cause said liquid carbon dioxide to pass directly from the liquid state into the gaseous state and exhaust to the atmosphere through said restricted orifice thereby chilling the food or beverage while retaining any residual carbon dioxide in said inner container in the liquid state; and an actuator to position said valve member between a first position to provide said restricted orifice and a second position so that said second surface is in position to provide said unrestricted flow path.

2. The self-chilling food or beverage container as defined in claim 1 wherein said valve member includes a molded plastic member having an outwardly extending lip having a continuous sharp edge which seats against said lower surface of said attachment adapter to provide said seal.

3. The self-chilling food or beverage container as defined in claim 1 wherein said outer container has a bottom surface defining an opening therein and said attachment adapter is disposed adjacent said opening in said bottom surface.

4. The self-chilling food or beverage container as defined in claim 1 wherein said attachment adapter includes a plastic over molded support ring having an outwardly extending flange having a top surface, said top surface being seated against the bottom surface of said outer container around said opening.

5. The self-chilling food or beverage container as defined in claim 1 wherein said inner container includes a threaded opening therein, said attachment adapter has a threaded extension thereon which is threadably received within said threaded opening in said inner container to secure said valve and said burst disc to said inner container.

6. The self-chilling food or beverage container as defined in claim 2 wherein said first bore at the upper surface of said attachment adapter defines a reentrant bore providing a shoulder, said second end of said valve member extending into said reentrant bore, a valve retainer secured to said second end of said valve member, a spring seated between said shoulder and said valve retainer to urge said continuous sharp edge of said valve member into contact with said lower surface of said attachment adapter.

7. The self-chilling food or beverage container as defined in claim 6 wherein said continuous sharp edge is flexible in response to urging from said spring moves outwardly against said lower surface of said attachment adapter to assist in providing said seal.

8. The self-chilling food or beverage container having a heat exchange unit using liquid carbon dioxide comprising:

an outer container for receiving a food or beverage;

the heat exchange unit including an inner container having an opening therein secured to said outer container and extending into said outer container so that an outer surface thereof is in contact with a food or beverage received within said outer container;

a burst disc secured to said inner container which is in constant communication with said liquid carbon dioxide and is adapted to rupture if the pressure of said liquid carbon dioxide exceeds a predetermined amount;

an attachment adapter having an upper and lower surface and defining a first bore therethrough and a circumferential protrusion adjacent the upper surface thereof secured to said heat exchange unit at said opening therein;

a molded plastic base member which fits over the bottom of said outer container and includes a snap ring having a plurality of discreet claws which cooperates with said circumferential protrusion on said attachment adapter to secure said attachment adapter with said valve member and burst disk to said outer container;

a valve member having first and second ends seated in said first bore in said attachment adapter, said valve member having a first diameter defining a first continuous surface adjacent the first end thereof spaced from said bore between 2 and 28 microns and a second diameter smaller than said first diameter defining a second surface extending from said first surface spaced from said bore to provide a flow path to permit liquid carbon dioxide under pressure to be unrestrictedly inserted into said inner container;

a seal between said valve member and said attachment adapter so that liquid carbon dioxide in said inner container is retained at a pressure and temperature to remain at equilibrium in said liquid state;

said first continuous surface, when said seal is removed, providing a restricted orifice to generate disequilibrium to cause said liquid carbon dioxide to pass directly from the liquid state into the gaseous state and exhaust to the atmosphere though said restricted orifice thereby chilling the food or beverage while retaining any residual carbon dioxide in said inner container in the liquid state;

an actuator to position said valve member between a first position to provide said restricted orifice and a second position so that said second surface is in position to provide said unrestricted flow path; and a gas deflector disposed over the upper surface of the attachment adapter to deflect gaseous state carbon dioxide exhausting through said first bore radially outwardly.

9. The self-chilling food or beverage container as defined in claim 8 wherein said base member includes a downwardly directed outer circumferential flange and defines a plurality of grooves extending radially outwardly to form a flow path for said gaseous state carbon dioxide to be directed outwardly and downwardly along the outer surface of said outer container by said circumferential flange.

10. The self-chilling food or beverage container as defined in claim 8 wherein the actuator includes a button-like member carried by said base member and includes a downwardly extending protrusion positioned over said second end of said valve member, said button-like member being movable downwardly when depressed so that said protrusion engages said valve member and moves it downwardly to move said sharp edge of said lip away from said lower surface of said attachment adapter to open said seal and provide said restricted orifice.

* * * * *